US010124228B1

(12) United States Patent
Leto

(10) Patent No.: US 10,124,228 B1
(45) Date of Patent: Nov. 13, 2018

(54) FOOTBALL TACKLING TRAINING SLED

(71) Applicant: Robert Leto, Schenectady, NY (US)

(72) Inventor: Robert Leto, Schenectady, NY (US)

( * ) Notice: Subject to any disclaimer, the term of this patent is extended or adjusted under 35 U.S.C. 154(b) by 236 days.

(21) Appl. No.: 14/876,963

(22) Filed: Oct. 7, 2015

(51) Int. Cl.
*A63B 69/34* (2006.01)

(52) U.S. Cl.
CPC .... *A63B 69/345* (2013.01); *A63B 2208/0204* (2013.01); *A63B 2243/007* (2013.01)

(58) Field of Classification Search
CPC ..... A63B 69/345; A63B 69/002; A63B 69/24; A63B 2071/025; A63B 21/4047; A63B 2243/007; A63B 2243/0066
See application file for complete search history.

(56) References Cited

U.S. PATENT DOCUMENTS 2,162,073 A 6/1939 Evans
2,696,383 A * 12/1954 Noftsinger ..... A63B 69/345 472/14
2,934,343 A * 4/1960 Schumacher ..... A63B 69/345 473/445
3,416,795 A * 12/1968 Lewis ..... A63B 69/345 473/444
3,514,105 A 5/1970 Pillard
3,658,332 A 4/1972 Adduci
4,688,792 A * 8/1987 Rivkin ..... A63B 69/345 473/443
4,802,670 A * 2/1989 Smith ..... A63B 69/345 473/445
5,090,696 A * 2/1992 Forrest, Sr. ..... A63B 69/345 473/444
5,385,523 A * 1/1995 Forrest ..... A63B 69/345 473/445
5,485,993 A * 1/1996 Lipsett ..... A63B 69/0071 473/448
5,800,291 A * 9/1998 Grover ..... A63B 69/0071 473/422
6,036,609 A * 3/2000 Gilman ..... A63B 69/345 473/445
6,309,327 B1 * 10/2001 Hallberg ..... A63B 69/345 482/83
D469,142 S 1/2003 Forrest
6,595,865 B2 * 7/2003 Stitz ..... A63B 69/0057 473/257
6,736,764 B1 * 5/2004 Kapustka ..... A63B 69/004 482/83
6,918,855 B2 * 7/2005 Dumont ..... A63B 21/06 482/51
6,942,585 B1 * 9/2005 Krause ..... A63B 69/002 473/441

(Continued)

*Primary Examiner* — Melba Bumgarner
*Assistant Examiner* — Amir Klayman

(57) ABSTRACT

The football tackling training sled is a device that is used to train football players how to tackle during a football practice. The football tackling training sled is further defined with a backbone support that is attached to a base member via a spring-loaded counter hinge. The backbone support is encapsulated with a padding so as to be impacted via a user. The backbone support rests at an obtuse angle with respect to the base member. The backbone support includes a track, which interfaces with a floating t-bar. The user impacts the backbone support with a lateral force while the user drives the floating t-bar upwardly and along the track.

1 Claim, 3 Drawing Sheets

(56) References Cited

U.S. PATENT DOCUMENTS

| | | | | |
|---|---|---|---|---|
| 7,147,579 | B2 * | 12/2006 | Forrest | A63B 69/345 473/422 |
| 7,322,893 | B2 | 1/2008 | Bright | |
| 7,794,337 | B2 | 9/2010 | Gamboa | |
| 7,828,701 | B1 * | 11/2010 | Chen | A63B 69/004 482/83 |
| 8,535,181 | B2 * | 9/2013 | Staten | A63B 21/0004 473/445 |
| 8,568,255 | B2 | 10/2013 | Staten | |
| 2006/0035734 | A1 | 2/2006 | Borunda | |
| 2013/0059699 | A1 * | 3/2013 | Brenner | A63B 69/004 482/83 |
| 2013/0143693 | A1 | 6/2013 | Forrest, Sr. | |
| 2013/0184104 | A1 * | 7/2013 | Gilman | A63B 69/345 473/445 |

* cited by examiner

FOOTBALL TACKLING TRAINING SLED

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of football and practice equipment, more specifically, a tackling sled that is used for football practice.

SUMMARY OF INVENTION

The football tackling training sled is a device that is used to train football players how to tackle during a football practice. The football tackling training sled is further defined with a backbone support that is attached to a base member via a spring-loaded counter hinge. The backbone support is encapsulated with a padding so as to be impacted via a user. The backbone support rests at an obtuse angle with respect to the base member. The base member is adapted to be positioned against a ground surface. The backbone support includes a track, which interfaces with a floating t-bar. The floating t-bar is encapsulated in padding, and is adapted to be driven upwardly when impacted via a user. The user impacts the backbone support with a lateral force whilst the user drives the floating t-bar upwardly and along the track. The floating t-bar is perpendicularly-oriented with respect to the track of the backbone support. The base member includes a counter weight member that is provided on a distal end, and which is opposite of the spring-loaded counter hinge. The spring-loaded counter hinge returns the backbone support from a recumbent position to an obtuse orientation once the backbone support is released from the user. The spring-loaded counter hinge includes an adjustment pin and a plurality of holes to adjust a starting angle of the backbone support with respect to the base member.

An object of the invention is to provide a tackling sled that is used to teach proper tackling to a user during a drill session of a football practice.

A further object of the invention is to provide a tackling sled that teaches proper alignment of the user when the user raises the floating t-bar whilst driving the backbone support from an obtuse orientation to the recumbent position.

An even further object of the invention is for the backbone support to return from the prone to the obtuse orientation once released from the recumbent position.

An even further object of the invention is for the floating t-bar to drop down the track to a bottommost position once the backbone support returns to the obtuse orientation.

These together with additional objects, features and advantages of the football tackling training sled will be readily apparent to those of ordinary skill in the art upon reading the following detailed description of the presently preferred, but nonetheless illustrative, embodiments when taken in conjunction with the accompanying drawings.

In this respect, before explaining the current embodiments of the football tackling training sled in detail, it is to be understood that the football tackling training sled is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the football tackling training sled.

It is therefore important that the claims be regarded as including such equivalent construction insofar as they do not depart from the spirit and scope of the football tackling training sled. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
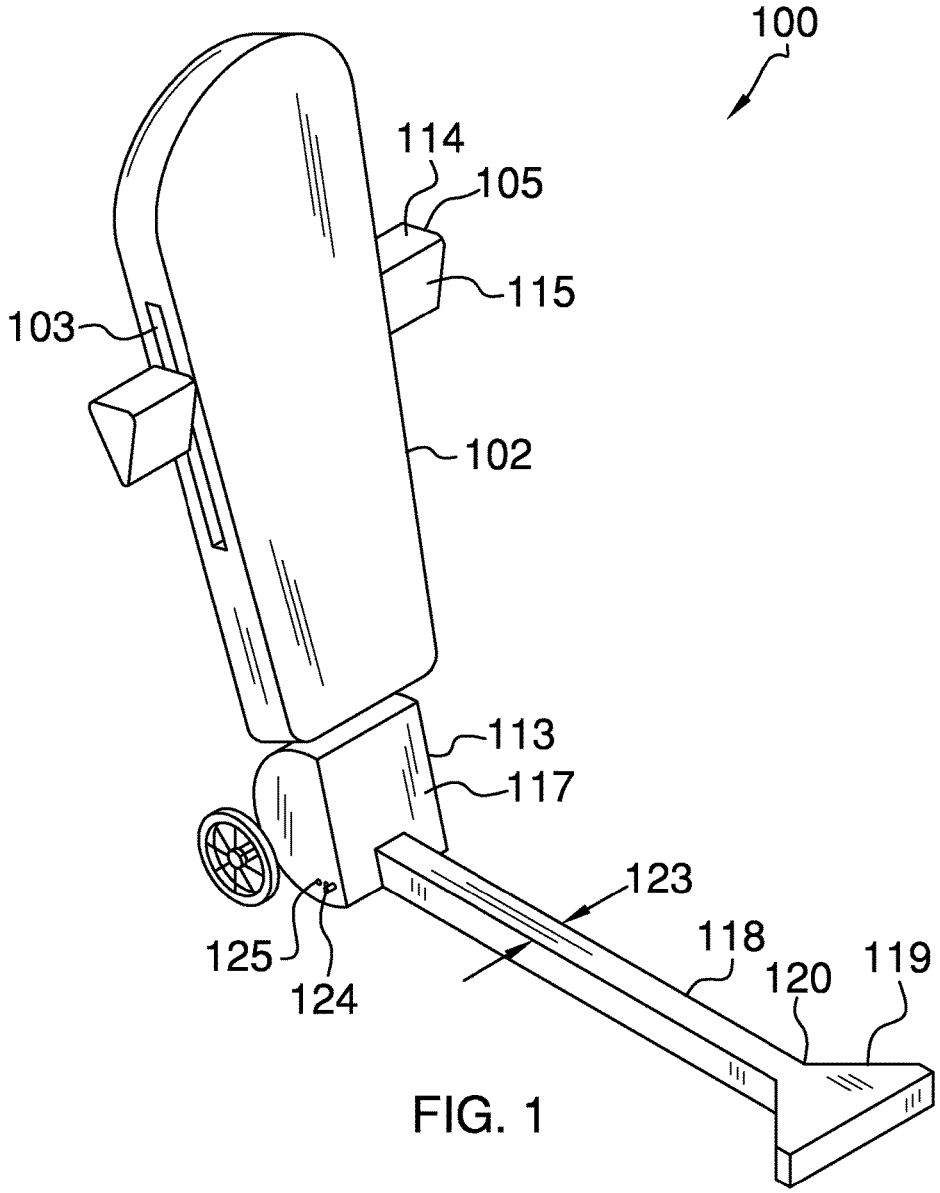
FIG. 1 is a perspective view of an embodiment of the disclosure.
Figure 3A:
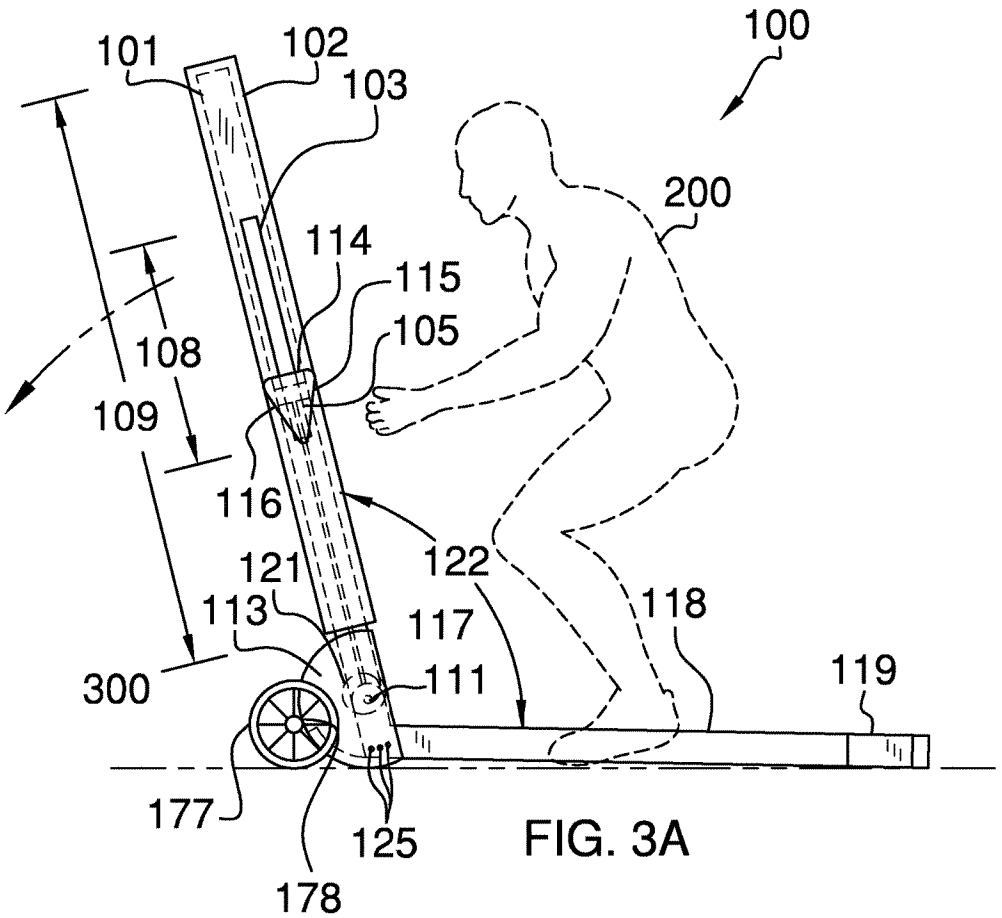
FIG. 3A is a side view of an embodiment of the disclosure in a starting position.
Figure 2:
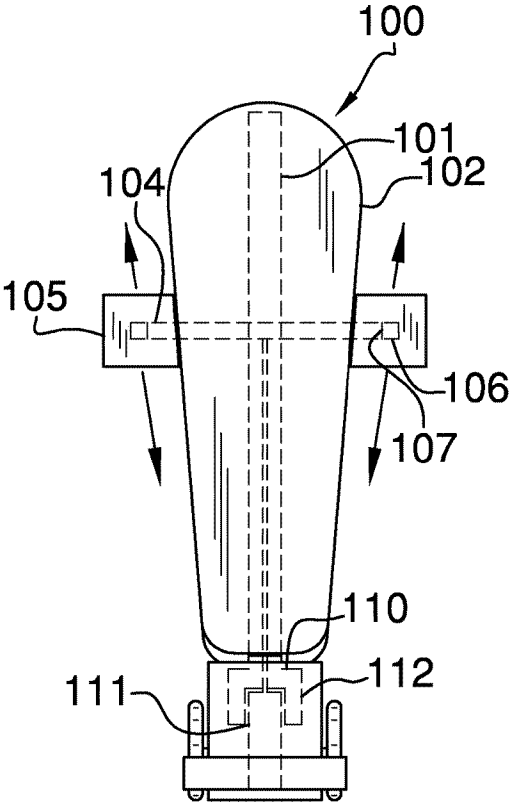
FIG. 2 is an end view of an embodiment of the disclosure.
Figure 3B:
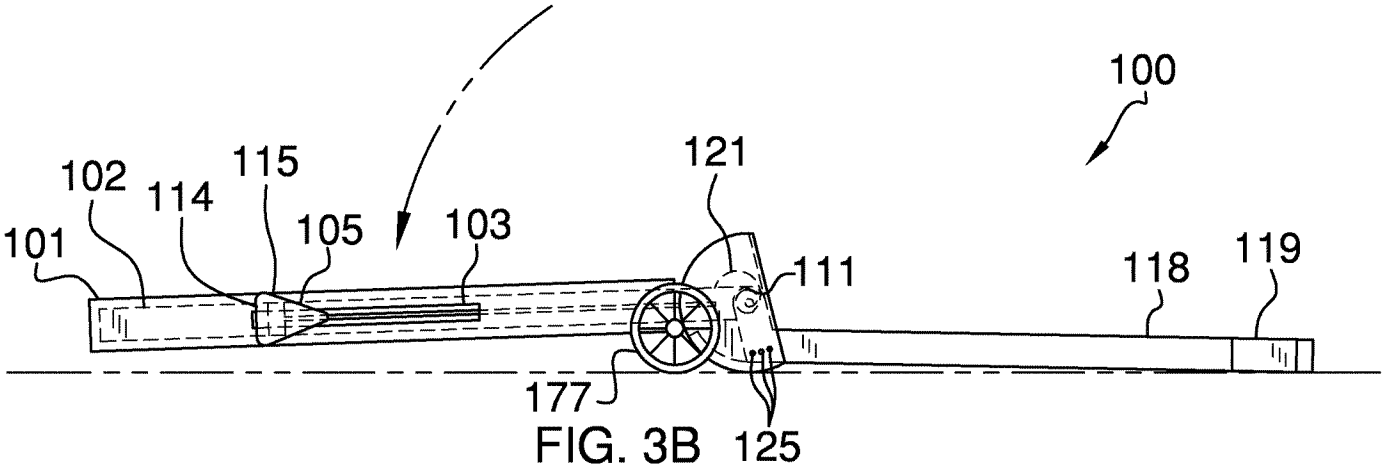
FIG. 3B is another side view of an embodiment of the disclosure in a ground position.
Figure 4:
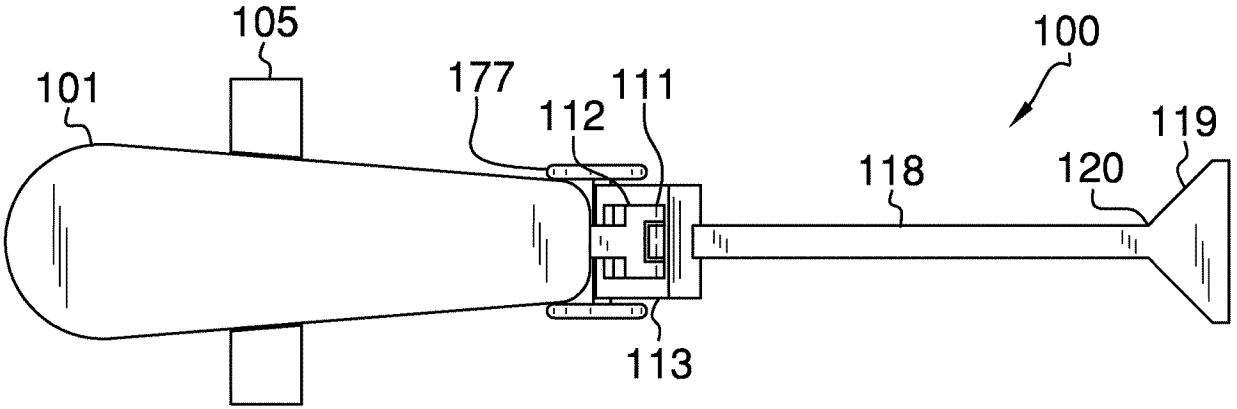
FIG. 4 is a top view of an embodiment of the disclosure in the ground position.

Detailed reference will now be made to a first potential embodiment of the disclosure, which is illustrated in FIGS. 1 through 4. The football tackling training sled 100 (hereinafter invention) includes a backbone support 101 that is encapsulated with a first padding 102. The first padding 102 is adapted to be impacted via a user 200. The backbone support 101 includes a track 103 that enables a floating t-bar 104 to slide upon. The floating t-bar 104 is perpendicularly-oriented with respect to the backbone support 101.

The floating t-bar 104 is encapsulated via a second padding 105. The second padding 105 is adapted to be impacted via the user 200. The floating t-bar 104 is able to slide up and down the track 103 of the back bone support 101. The second padding 105 has a triangular cross-section such that the floating t-bar 104 includes lateral members 106 provided on distal ends 107 of the floating t-bar 104. The triangular cross-section of the second padding 105 places a first surface 114 facing upwardly, and said first surface 114 has a greater surface area when compared to a second surface 115 or a third surface 116. The second surface 115 faces downwardly and away from the first padding 102.

The track 103 of the backbone support 101 is further defined with a track length 108 that is less than a backbone length 109 of the backbone support 101. The backbone support 101 is further defined with a first distal end 110. The first distal end 110 attaches to a spring-loaded counter hinge 111. The first distal end 110 attaches to a U-shaped member 112 that attaches directly to the spring-loaded hinge 111. The spring-loaded counter hinge 111 is encapsulated in a third padding 113. The third padding 113 has a hemi-cylindrical shape, and which is further defined with a fourth surface 117 that is flat. The fourth surface 117 faces the user 200. The fourth surface 117 is parallel with the first padding 102 when the invention is in the starting position of FIG. 3A.

The spring-loaded counter hinge 111 is encapsulated within the third padding 113. Moreover, the spring-loaded counter hinge 111 is attached to a base member 118 that is adapted to be positioned on a ground surface 300. The base member 118 includes a counter weight 119 that is provided at a second distal end 120. The second distal end 120 is opposite of where the base member 118 attaches to the spring-loaded counter hinge 111. The counter weight 119 is triangularly-shaped, and adapted to increase the overall weight of the base member 118.

The spring-loaded counter hinge 111 includes a spring 121 that biases the backbone support 101 at an obtuse angle 122 with respect to the base member 118. Moreover, the base member 118 has a base width 123 that is not more than 4 inches, and which enables the user 200 to straddle the base member 118 when using the invention 100. The spring-loaded counter hinge 111 includes a pin 124 that is insertable into one of a plurality of pin holes 125 in order to adjust the obtuse angle 122 formed between the base member 118 and the backbone support 101.

In use, the user 200 impacts the first padding 101 with a forward force whilst simultaneously impacting the second padding 105 with a forward and upward force shooting their arms. The impacting of the second padding 105 pushes the backbone support 101 to a recumbent position with the ground 300. Once the backbone support 101 is recumbent with the ground 300, the user 200 releases the invention 100, and the spring-loaded counter hinge 111 returns the backbone support 101 to the obtuse angle 122 with respect to the base member 118. Also, the floating t-bar 104 returns from a sixth distal end 130 of the track 103 to a seventh distal end 131 of the track 103. The seventh distal end 131 of the track 103 is closer to the spring-loaded counter hinge 111.

The third padding 113 includes at least one wheel 177 that is provided at an outermost point 178 of the third padding 113. The at least one wheel 177 mobilizes the invention 100 when not in use. The at least one wheel 177 rotates with respect to an axle 179. The axle 179 is adjacent the outermost point 178 of the third padding 113.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A football tackling training sled comprising:

a backbone support in pivotable connection with a base member via a spring-loaded counter hinge;

wherein the spring-loaded counter hinge returns the backbone support from a recumbent position with a ground to an obtuse angle formed between the backbone support and the base member;

wherein the backbone support is adapted to be impacted via a user with a forward and downward force; a floating t-bar is slideably engaged with the backbone support is adapted to be impacted via the user in a forward and upward force;

wherein the backbone support is encapsulated with a first padding;

wherein the first padding is adapted to be impacted via the user;

wherein the backbone support includes a track that enables the floating t-bar to slide upon;

wherein the floating t-bar is perpendicularly-oriented with respect to the backbone support;

wherein the floating t-bar is encapsulated with a second padding;

wherein the second padding is adapted to be impacted via the user;

wherein the floating t-bar is able to slide up and down the track of the backbone support;

wherein the second padding has a triangular cross-section and the floating t-bar includes lateral members provided on distal ends of the floating t-bar;

wherein the triangular cross-section of the second padding places a first surface facing upwardly;

wherein the second padding is further defined with a second surface and a third surface that faces downwardly and away from the first surface;

wherein the track of the backbone support is further defined with a track length that is less than a backbone length of the backbone support;

wherein the backbone support is further defined with a first distal end;

wherein the first distal end attaches to a U-shaped member that attaches directly to the spring-loaded counter hinge;

wherein the spring-loaded counter hinge is encapsulated in a third padding;

wherein the third padding has a hemi-cylindrical shape;

wherein the spring-loaded counter hinge is attached to the base member;

wherein the base member includes a counter weight that is provided at a second distal end;

wherein the second distal end is opposite of where the base member attaches to the spring-loaded counter hinge;

wherein the counter weight is triangularly-shaped, and increases the overall weight of the base member;

wherein the spring-loaded counter hinge includes a spring that biases the backbone support at the obtuse angle with respect to the base member;

wherein the base member has a base width that is not more than 4 inches, and which is adapted to enable the user to stand to either side of the base member;

wherein the spring-loaded counter hinge includes a plurality of pin holes and a pin that is insertable into one of the plurality of holes in order to adjust the obtuse angle formed between the base member and the backbone support;

wherein the third padding includes at least one wheel;

wherein the at least one wheel mobilizes the football tackling training sled when not in use;

wherein the at least one wheel rotates with respect to an axle;

wherein the axle is adjacent the outermost point of the third padding.

* * * * *